US007163205B1

(12) United States Patent
Kecskes et al.

(10) Patent No.: US 7,163,205 B1
(45) Date of Patent: Jan. 16, 2007

(54) RECOVERY APPARATUS FOR FRAGMENTED BALLISTIC MATERIALS AND METHOD FOR COLLECTION OF THE SAME

(75) Inventors: Laszlo J. Kecskes, Havre de Grace, MD (US); Lee S. Magness, Jr., Joppa, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 112 days.

(21) Appl. No.: 10/672,268

(22) Filed: Sep. 23, 2003

(51) Int. Cl.
*F41J 1/12* (2006.01)

(52) U.S. Cl. ..... 273/410

(58) Field of Classification Search ..... 273/404, 273/410

See application file for complete search history.

(56) References Cited

U.S. PATENT DOCUMENTS

| | | | | |
|---|---|---|---|---|
| 941,642 | A * | 11/1909 | Maxim | 273/410 |
| 4,445,693 | A * | 5/1984 | Angwin | 273/404 |
| 4,728,109 | A * | 3/1988 | Simonetti | 273/410 |
| 5,162,600 | A * | 11/1992 | Cody et al. | 588/318 |
| 5,441,280 | A * | 8/1995 | Copius | 273/410 |
| 5,573,344 | A | 11/1996 | Crane et al. | 403/179 |
| 5,609,210 | A | 3/1997 | Galbraith et al. | 169/26 |
| 5,654,053 | A | 8/1997 | Crane et al. | 428/36.5 |
| 5,799,948 | A * | 9/1998 | Moberg | 273/410 |
| 5,833,782 | A | 11/1998 | Crane et al. | 156/60 |
| 6,019,176 | A | 2/2000 | Crouch | 169/46 |
| 6,196,107 | B1 | 3/2001 | Hoffman et al. | 86/50 |
| 6,264,735 | B1 * | 7/2001 | Bean et al. | 106/672 |
| 6,464,903 | B1 | 10/2002 | Blount | 252/609 |
| 6,688,811 | B1 * | 2/2004 | Forrester | 405/129.25 |
| 2004/0024283 | A1 * | 2/2004 | Forrester | 588/259 |

OTHER PUBLICATIONS

Rogers, H.C., "Adiabatic Plastic Deformation," Ann. Rev. Mater. Sci., 9:283-311, 1979.

Magness, L.S. and T.G. Farrand, "Deformation Behavior and Its Relationship to the Penetration Performance of High-Density Kinetic Energy Projectile Materials," Proceedings of the 1990 Army Science Conference, 149-165, 1990.

Johnson, W.L., "Bulk Glass-Forming Metallic Alloys: Science and Technology," MRS Bulletin, 24(10):42-56, 1999.

Spaepen, F., "A Microscopic Mechanism for Steady Stats Inhomogeneous Flow in Metallic Glasses," Acta. Met., 25(4):407-415, 1977.

Subhash, G., R.J. Dowding, and L.G. Kecskes, "Characterization of Uniaxial Compressive Response of Bulk Amorphous Zr-Ti-Co-Ni-Be Alloy," Mat. Sci. and Eng., A334(1):33-40, 2002.

Magness, L., L. Kecskes, M. Chung, D. Kapoor, F. Biancaniello and S. Ridder, "Behavior and Performance of Amorphous and Nanocrystalline Metals in Ballistic Impacts," Proceedings of the 19th International Ballistic Symposium, Intertaken, Switzerland, May 6-11, 2001.

Wright, W.L., R. Saha and W.D. Nix, Deformation Mechanism of the Zr40Ti14Ni10Co12Be24 Bulk Metallic Glass, Mater. Trans., 42(4):642-649, 2001.

* cited by examiner

*Primary Examiner*—Mark S. Graham
(74) *Attorney, Agent, or Firm*—Edward L. Stolarun

(57) ABSTRACT

The present invention provides a ballistic testing recovery apparatus and method for allowing post impact analysis of pyrophoric projectile debris wherein the apparatus comprises a containment chamber having an interior volume filled with a solvent-soluble granulated material. The containment chamber is formed with an aperture in a side wall for receiving a launched projectile therethrough. The projectile impacts a target plate disposed in the containment box and projectile debris is thereafter ejected into the surrounding solvent-soluble granulated material. The solvent-soluble granulated material operates to capture and quench the projectile debris before devitrification and/or crystallization erodes the "as-ejected" characteristics of the pyrophoric projectile debris.

15 Claims, 7 Drawing Sheets

RECOVERY APPARATUS FOR FRAGMENTED BALLISTIC MATERIALS AND METHOD FOR COLLECTION OF THE SAME

GOVERNMENT INTEREST

The invention described herein may be manufactured, used, and licensed by or for the United States Government.

FIELD OF THE INVENTION

The present invention relates generally to an apparatus and a method for containment and in particular to an apparatus and a method for the recovery of the erosion products and back-extruded fragments ejected during the impact of a high velocity projectile with a target.

BACKGROUND OF THE INVENTION

In depleted uranium (DU) alloy projectiles, adiabatic shear (AS) banding serves as a self-sharpening mechanism. The onset of plastic instability, as thermal softening overcomes internal work-hardening mechanisms, results in these localizations. The AS bands provide a failure mechanism by which the DU projectile can discard deforming material at its head, reducing or preventing the build-up of a large mushroomed head, and allow the DU projectile to efficiently burrow through armor.

Efforts to develop alternatives to DU for projectile applications have focused on imparting a similar deformation behavior in tungsten heavy alloys (WHAs). Conventional WHAs are two-phase composites of nearly unalloyed tungsten particles embedded in a nickel (Ni) alloy matrix, produced by liquid-phase sintering of metal powders. Because the W phase itself is very resistant to AS localization, primary focus has been placed on replacing the Ni alloy matrix with an alloy matrix having a greater susceptibility to AS failure that may illustratively include alloys formed of at least one or more pyrophoric components such as uranium (U), titanium (Ti), zirconium (Zr), or hafnium (Hf).

The recent development of Zr- or Hf-based bulk metallic glass alloys (BMGs), of compositions with much lower critical cooling rates and thus castable in thicker sections, makes them interesting candidates for projectile material applications. Specifically, BMGs generally possess very high elastic strain limits (2% to 3%) and therefore very high yield strengths (between 1.6 GPa and 2.0 GPa). Beyond their elastic limits, however, BMGs do not strain harden, and plastic deformation is immediately localized into shear bands. Shear bands thus serve as a BMG's sole mechanism of plastic flow, under quasi-static as well as dynamic loads. The localization is generally modeled as resulting from a reduction in local viscosity, associated with an increase in "free volume" as atoms move within the amorphous structure, but there is not a universally agreed-upon explanation for this behavior. At higher strain rates, the additional thermal-softening component leads to an earlier failure along one of the first shear bands, reducing the net accumulation of the plastic deformation.

The differences in the shear banding behaviors of DU alloys versus BMGs or W-based BMG matrix composites (W-BMG) leave many questions about the potential of BMG composites to ballistic applications. However, subscale ballistic tests of monolithic Hf-based BMGs and W-BMGs have shown that the post-impact evaluation of residual projectile and erosion products recovered in a steel target plate can be inherently difficult. Because of their low crystallization temperatures, the heat generated by friction and by the plastic work done to the steel target in opening the penetration cavity, causes devitrification (i.e., crystallization or loss of the amorphous substructure) of the "as-sheared" BMG matrix, thereby erasing the evidence of any shearing behavior.

Projectile cores are typically fired from a laboratory gun system having a 10-ft (3-m) long, thick walled, smooth bore gun; a 38-mm bore diameter; and a fitted 40-mm breech system as generally illustrated in prior art FIG. 1. This system allows for very controlled launch velocities and relatively gentle launch accelerations. The projectile is assembled in a four piece plastic sabot and push launched from behind by a 0.3-in (7-mm) thick steel disk set in a polypropulux obturator (not shown). The obturator traps the gases behind the launch package and accelerates the projectile down the barrel. The barrel is located approximately 2–3 m from the target impact. This short flight distance eliminates the need for any flight stabilization via fins or spin.

Still referring to prior art FIG. 1, a conventional experimental facility may be instrumented with radiographic equipment to capture the terminal ballistic event. In this manner, two images of the projectile can be captured prior to impact, in both the horizontal and vertical planes. Reference fiducial wires on X-ray radiographs R are used to determine the orientation of the projectile. By measuring the positions of the projectile images relative to the fiducial wires and the preset time delays between successive images, all pertinent information relative to speed and orientation is determined. The radiographs also serve to record the images of the residual projectile and target debris.

Typically, subscale projectile materials are launched at modest velocities and impact a hardened steel target, placed at the rear of the test stand. As the projectile impacts the target surface, extreme pressures cause it to fail, leading to backward jets of finely divided fragments. While usually unpracticed, if desired, fragments of the erosion products from the projectile could be captured in a containment box.

For conventional projectile materials (e.g., WHAs) this technique would be quite sufficient. However, for BMG-based projectile materials this method is inadequate. Particularly, a BMG material consisting of about 65 to 70% by weight Zr or Hf, both of which are pyrophoric, would instantaneously burn up or chemically react with the surrounding air. Moreover, fragments of the residual projectile or its erosion products that remain in contact with the hot steel of the target plate would readily devitrify. Thus, a need exists for a ballistic testing recovery apparatus and method that will allow for post-impact evaluation of the "as-ejected" characteristics of residual projectile and erosion products which may be susceptible to pyrophoric degradation.

SUMMARY OF THE INVENTION

The present invention provides a ballistic material testing apparatus and method for recovering pyrophoric, or non-pyrophoric, projectile material fragments ejected from a target material disposed within the apparatus. The apparatus includes a projectile containment chamber having an interior volume and an aperture formed in a wall of the containment chamber for receiving a launched projectile therethrough. A solvent-soluble granulated material is disposed within the containment chamber and substantially fills the remainder of the interior volume not occupied by the target material. The solvent-soluble granulated material is operative to capture and quench the pyrophoric projectile material fragments that result from a projectile impacting the target material after being launched through the aperture. The solvent-soluble granulated material is thereafter dissolved and the projectile material fragments are separated from the solution by sieving and thereafter preferably magnetically separated from the target material debris.

BRIEF DESCRIPTION OF THE DRAWINGS

A better understanding of the present invention will be had upon reference to the following detailed description when read in conjunction with the accompanying drawings in which like parts are given like reference numerals and wherein.

DESCRIPTION OF THE PREFERRED EMBODIMENTS

The present invention describes an inventive ballistic material recovery apparatus and method that has utility in the testing of projectile target penetration. It is appreciated that the target materials used in ballistic testing may vary broadly and the target materials described herein are not intended to limit the scope of the invention. As such, target materials subject to testing may illustratively include metallic, ceramic, and composite materials. An inventive apparatus 10 preferably is comprised of a mild steel containment chamber 11 filled with a common dry, granulated solvent-soluble material. It is appreciated that the containment chamber 11 may be constructed of materials other than steel but it is essential that all such materials have properties that facilitate the containment of projectiles launched in ballistics testing. Such material may illustratively include aluminum, laminated-tempered glass, Plexiglas and/or sheet materials such as wood shrouded with flak material. An inventive apparatus 10 is shown generally in FIGS. 2 and 3.

Figure 1:
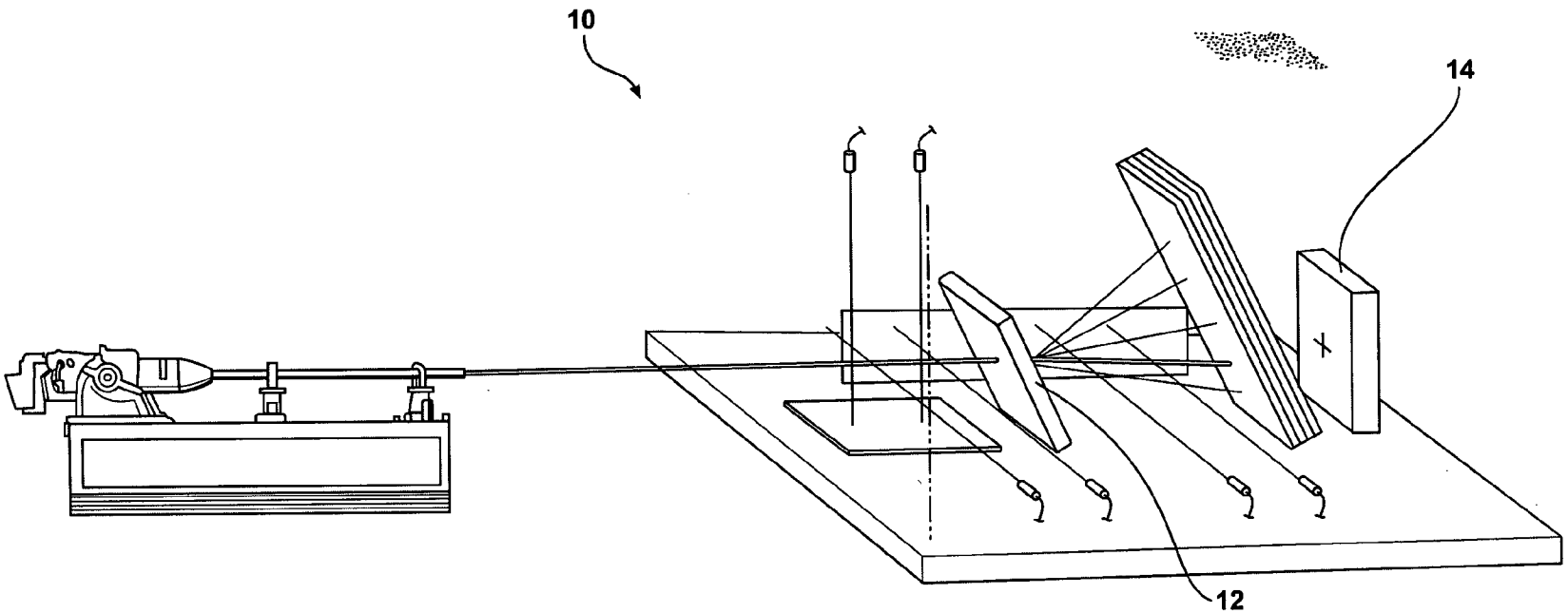
FIG - 1 PRIOR ART
FIG. 1 illustrates a prior art ballistic testing arrangement.
Figure 2:
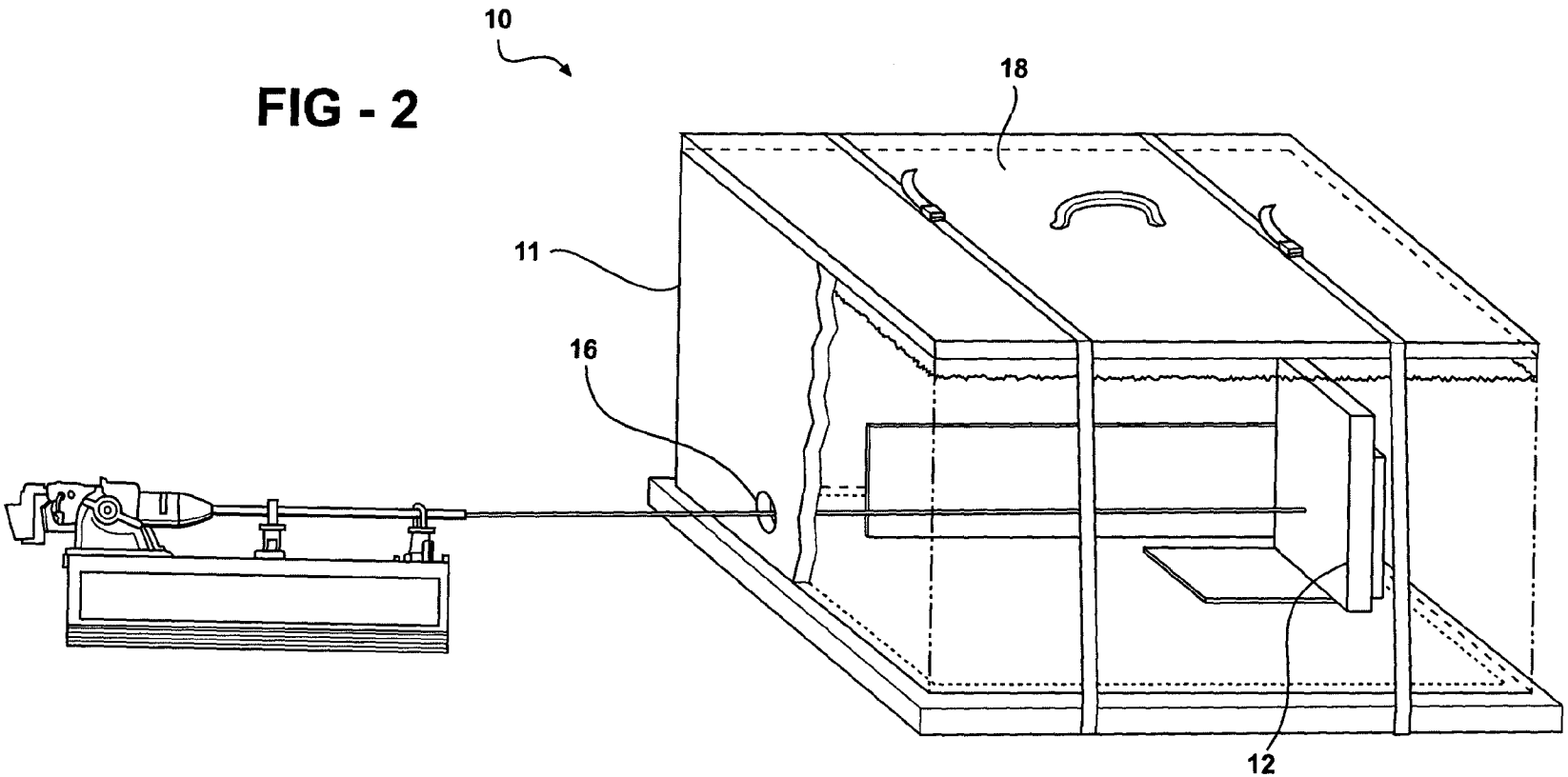
FIG. 2 illustrates a ballistic testing arrangement including the projectile containment box in accordance with the invention.
Figure 3:
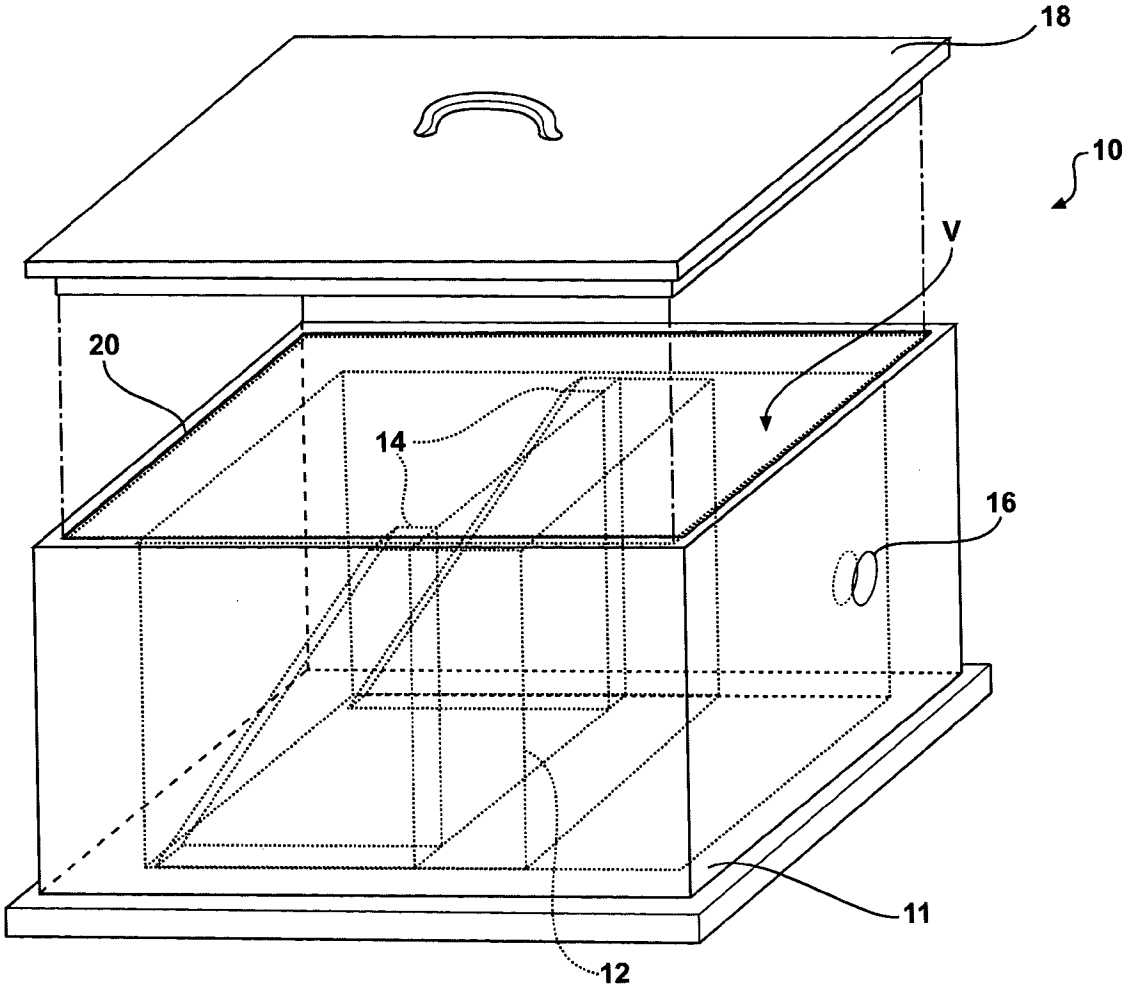
FIG. 3 is a perspective view of the projectile containment box with lid and interior volume, backstops and target material illustrated in phantom line in accordance with the invention.
Figure 4B:
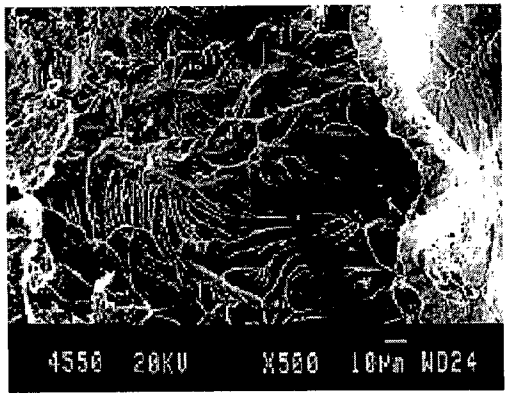
FIGS. 4*a*–4*d* are scanning electron microscope (SEM) images of typical fracture surfaces of recovered ejecta: (a) "veinal," (b) conchoidal fracture, (c) smearing, and (d) melting patterns.
Figure 4D:
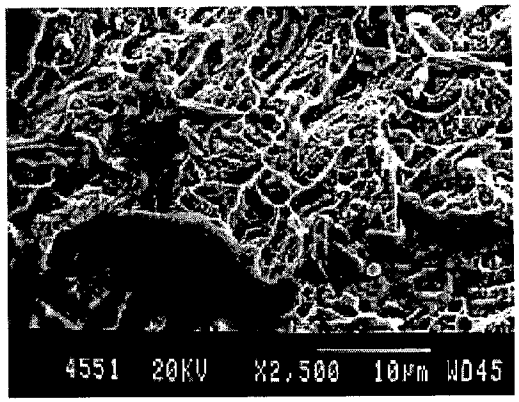
Figure 4A:
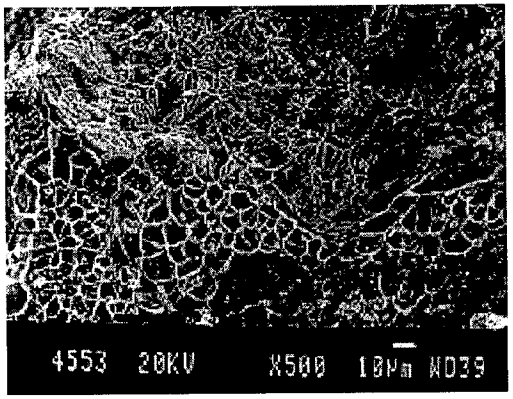
Figure 4C:
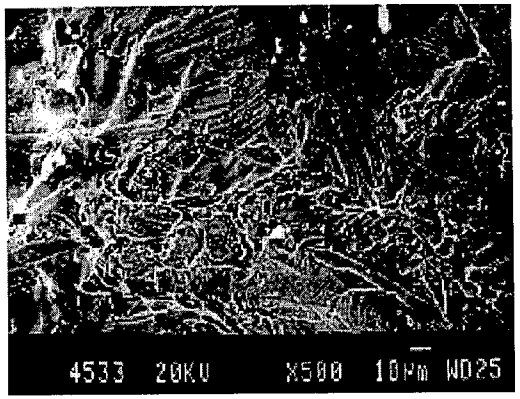

The construction of the preferred embodiment containment chamber 11 entails the use of at least 0.20-inch thick mild steel sheets, inert gas tungsten arc welded to form an open box. Most preferably the containment chamber 11 is formed of 0.5-inch thick steel sheets and a further embodiment may consist of the use of 1.0-inch thick steel, designed to withstand the greater ballistic shock loading from the projectile impact. In ballistic tests in which the projectile will not be able to perforate the target plate 12, the target plate 12 is inserted in the containment chamber 11 at the rear, and the remaining volume of the containment chamber 11 in front of the target plate 12 is filled with granulated solvent-soluble material as shown in FIG. 2. In tests where the projectile perforates the target plate 12 and samples of the behind armor debris, namely the residual projectile and its erosion products, can be captured, the target plate 12 is placed in the center of the containment chamber 11 against steel back stops 14 welded to the interior sides of the containment chamber 11.

The granulated solvent-soluble material tends to capture, quench, smother, extinguish or suppress any burning pyrophoric fragments or erosion products that might be back ejected from a penetration cavity, or remain disposed on the cavity walls after a projectile impacts the target plate 12. The apparatus 10 is also operative when the projectile perforates the target plate 12; in this case, both back and forward ejected fragments are optionally captured. While granulated extinguishing media such as dry sand, graphite, dolomite, and carbon dioxide are operative to capture and extinguish the ejected pyrophoric fragments, these materials are preferably selected in instances where there is limited need for the collection of target and/or projectile fragments. It is appreciated that an extinguishing media that is not dissolvable in water or other solvent makes projectile fragment collection more labor intensive. Likewise, it is appreciated that a granulated extinguishing medium is selected with a recognition as to whether there is a potential for reaction between the media and fragments of a given projectile. A medium reactive towards compositional components of a projectile fragment under well known temperature conditions is recognized to be an indirect measure of the projectile-target impact conditions. For example, graphitic carbon is reactive with titanium, zirconium, uranium and/or hafnium under ballistic testing conditions. Preferably, the granulated extinguishing medium is an aqueous or organic solvent soluble substance that is non-combustible and non-reactive under ballistic testing conditions. More preferably, the granulated extinguishing media is a salt illustratively including salts of alkali metal, alkali earth, main group and group III metals, where the unions illustratively include halides, acetates, silicates, sulfates or combinations thereof. Specific salts operative herein illustratively include lithium halides, sodium halides, potassium halides, magnesium halides, calcium halides, and aluminum chloride. Most preferably, the solvent-soluble granulated material is sodium chloride (NaCl).

An inventive method for capturing the projectile fragments of BMG projectiles as well as those made from any other pyrophoric materials, such as depleted uranium is also provided. The inventive method involves the construction of the aforementioned apparatus, set-up of a ballistic test, passive collection of the penetration fragments, post-ballistic recovery operations, and separation of the granulated material from the projectile material fragments. The present invention provides more accurate information about the deformation of the projectile during the impact and penetration events as compared to the prior art.

The present invention derives from the observation that until a projectile embeds itself to a significant depth into a target plate, any erosion products from the head of the projectile are immediately ejected outward and away from the front face of the target plate. Consequently, the steel target plate of the present invention is placed at the rear end of the containment chamber 11 that is designed to capture any part or all of the projectile ejecta. Furthermore, in the preferred embodiment, the containment chamber 11 is filled with granulated extinguishing media, preferably granulated table salt (NaCl). The salt crystals serve to decelerate projectile fragments and inhibit oxidation or nitridation processes associated with hot Zr- and Hf-based BMG projectile fragments. The projectile fragments are suspended in the granulated media in a scatter pattern that is useful in ballistic analysis. It is appreciated that a granular medium grain size of comparable size to the smallest projectile fragments affords particularly effective trapping of such fragments. Moreover, the intimacy of contact between the medium grains and the projectile fragments also facilitates a rapid thermal quenching process. The ballistic testing equipment/setup optionally includes X-ray radiographs for capturing images of a resulting scatter pattern as well as additional information relative to projectile speed and orientation before and/or after target impact. It is appreciated however that such radiograph equipment is provided to the ballistic testing setup in a manner that does not interfere with the launched projectile or projectile fragments during testing.

After each launching, the salt is preferably dissolved in water or other solvent and the projectile and target debris are sieved from the solution and thereafter preferably magnetically separated. It is appreciated that a degassed aqueous or organic solvent is operative herein to preclude projectile fragment oxidation associated with the granulated media dissolution that might obscure subsequent fragment analysis for a given projectile. It is also appreciated that other methods of separating the projectile fragments may be used that are known to be more efficient by those skilled in the art. The most efficient separation method may be dependent on the type of material used to construct the containment chamber 11 and thus the preferred method of separation described herein is not intended to operate as a limitation on the inventive method.

The projectile debris and erosion products recovered in the above manner provide a view of the intrinsic deformation and failure modes of projectile materials in general and specifically those of the BMG alloys or W-BMG composites without the added degradation due to post-impact heating by the steel target. Because most of the fragments collected have been immediately ejected from the target plate and did not remain in contact with the walls of the penetration cavity, these fragments have not been subjected to additional heating by post-impact steel target plate 12.

An aperture 16 having a diameter of at least 20 mm, and preferably about 20–45 mm in diameter, and most preferably 25 mm in diameter is created in the front face of the containment chamber 11. The aperture 16 allows the subscale projectile to enter the containment chamber 11 and impact the target plate 12. A thin membrane is optionally provided over the aperture 16 to contain the salt fill, yet not interfere with the flight and speed of the high velocity subscale projectile. This membrane is optionally formed by placing duct tape over the interior side of the aperture 16. However, it is appreciated that other materials suitable for such purpose may be used without departing from the scope of the invention. Additionally, the front wall of the containment chamber may optionally be formed of thin sheet material whereby an aperture is not needed as the projectile is capable of penetrating therethrough essentially unimpeded.

The interior volume of the containment chamber 11 must be sufficient to allow for the kinetic energy delivered by the impacting projectile to be safely absorbed by the granulated medium and the containment chamber 11. Preferably, a lid 18 for the containment chamber 11 is strapped onto the top of the containment chamber 11 with steel shipping bands 22. This allows for some limited movement of the lid 18 during the impact event and absorption of the impact energy without failure of the containment chamber 11 itself.

A gasket 20 optionally is provided between the rim of the containment chamber 11 and the lid 18 that allows for limited movement without permitting the escape of the salt or the ejected projectile erosion products dispersed in the salt fill. The gasket 20 is preferably formed of rubber; however, other suitable materials illustratively include plastic, synthetic material and cork material.

The following examples are illustrative of the applicability and advantages of using the ballistic material recovery apparatus and method according to the invention.

EXAMPLE 1

To demonstrate the applicability of this invention, two types of BMG rods are produced by a vacuum-tungsten-arc-melt-suction-casting method: a $Zr_{57}Nb_5Ni_{12.6}Cu_{15.4}Al_{10}$ (at. –%), [Zr—BMG]; (density, $\rho$=7.0 g/cm$^3$; liquidus temperature, $T_{liq}$=850° C.; compressive strength, $\sigma_y$=1.6 GPa), and a $Hf_{52.5}Ti_5Ni_{14.6}Cu_{17.9}Al_{10(at.\ -\%)}$, [Hf—BMG]; (density, $\rho$=11.1 g/cm$^3$; liquidus temperature, $T_{liq}$=1,000° C.; compressive strength, $\sigma_y$=2.2 GPa). The two alloys are produced by first arc melting the elemental constituents under an argon atmosphere (⅓ bar). The melt is then quickly drawn into a cold, hollow copper mold and cast into rods approximately 70 mm long and slightly over 3 mm in diameter. Small sections of each rod are taken for X-ray diffraction (XRD), metallography, and scanning electron microscopy (SEM) examinations, and the remaining material is machined into 3 mm in diameter by roughly 50 mm in length, subscale projectiles for ballistic testing. Both rods successfully survived ballistic launch. No residual stubs of projectile were found in the penetration tunnels, but the eroded projectile debris lining the penetration tunnel was examined.

When launched at speeds that range between 500–2000 m/s, and during impact, the BMG rods break up into coarse and fine fragments ranging from submillimeter size to about 4 mm. There is no correlation between the BMG density and the amount of ejecta recovered. Larger fragments correspond to broken rod segments failing along a single failure plane; small fragments are just more comminuted during the erosion process. At low velocities, e.g. 500 m/s, the BMG ejecta contain considerably more fine debris. Whereas, at high velocities, the recovered ejecta is coarser, i.e., larger than 4 mm, and does not have any submillimeter fragments.

Figure 5:
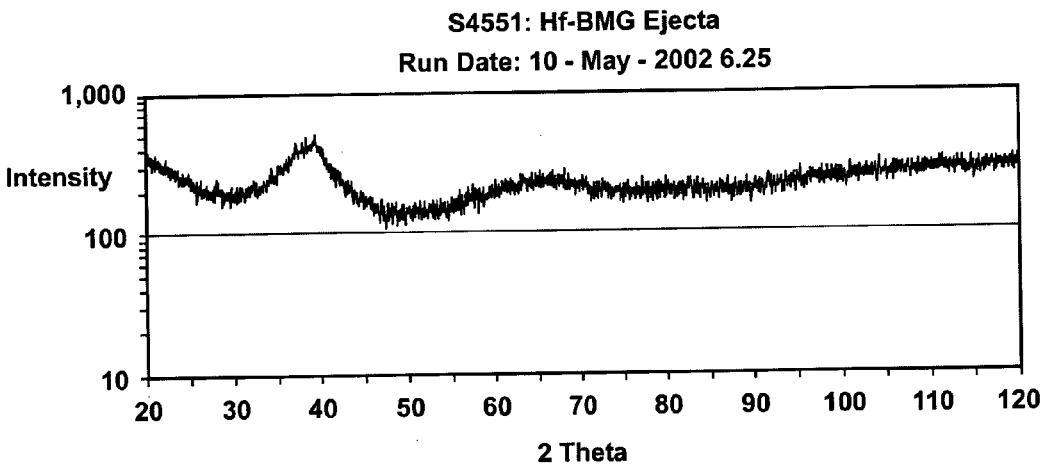
FIG. 5 is an X-ray diffraction pattern obtained from Hf—BMG projectile residual fragments in accordance with the preferred embodiment of the invention.
Figure 6:
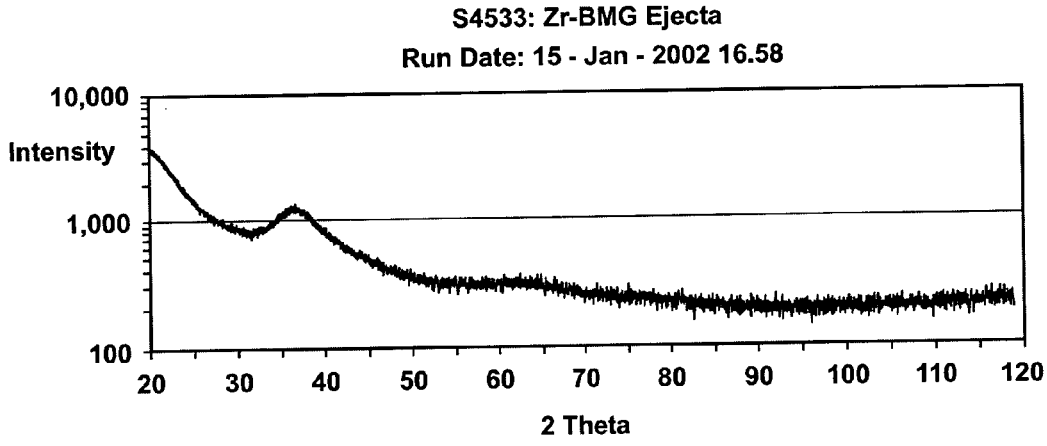
FIG. 6 is an X-ray diffraction pattern obtained from Zr—BMG projectile residual fragments in accordance with the preferred embodiment of the invention.

FIGS. 4(*a*) through 4(*d*) typify the characteristic features of the different failure modes as observed by SEM. Most commonly and consistent with previous studies, failure occurred by shearing immediately followed by separation and the formation of "veinal" patterns, as shown in FIG. 4(*a*). The "veinal" regions are interspersed with conchoidal fractures where the veins do not develop as shown in FIG. 4(*b*). Surfaces also show evidence of smearing, FIG. 4(*c*), and post-impact melting, FIG. 4(*d*). There is less melting of the Hf—BMG fragments than those of the Zr—BMG. XRD analysis, depicted in FIGS. 5 and 6, of both coarse and fine Hf—BMG and Zr—BMG ejecta show only broad scattering features without any sharp Bragg diffraction peaks indicative of little devitrification or recrystallization during break up.

Target cavities yield information related to the post-impact behavior of BMG melting and/or devitrification. More erosion products are found in the Hf—BMG cavity than in that of the Zr—BMG cavity. Where a thin BMG coating is found on the walls, the coating is still mostly amorphous. Where the coating is thicker, it is devitrified and crystalline. On occasion, the thick coating contained bubbles or voids, indicative of complete melting at some point during the penetration and erosion process. Similar to the earlier results, the melted Hf—BMG coating contains shrinkage cracks consistent with a volume change upon devitrification.

EXAMPLE 2

Figure 7B:
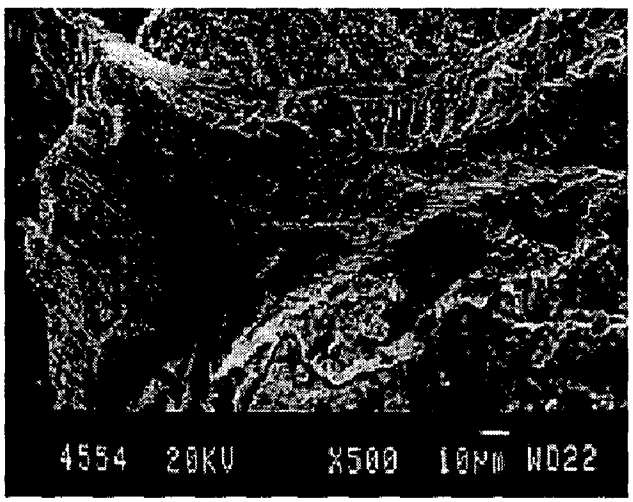
FIGS. 7*a*–7*b* illustrate the axial (a) and transverse (b) SEM images of a recovered piece of the W-BMG projectile residual, showing bimodal failure and no devitrification of the BMG matrix, respectively.
Figure 7A:
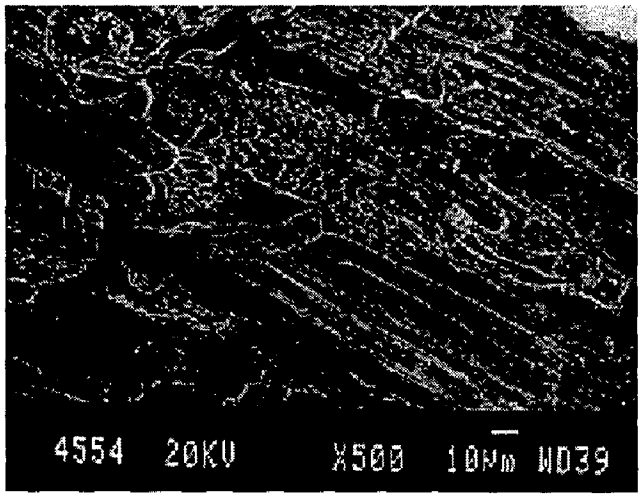

Another recovery test is conducted with a wire-reinforced W-BMG [W—$Zr_{57}Nb_5Ni_{12.6}Cu_{15.4}Al_{10}$ matrix] composite with geometries and impact conditions according to Example 1. The steel target is positioned at the rear of a containment box that is then filled with NaCl according to the present invention. A close examination of the debris is shown in FIGS. 7(*a*) and 7(*b*). The recovered W-BMG fragment did not experience extreme heating causing the BMG matrix to devitrify. The effectiveness of NaCl to suppress localized heating is demonstrated by the bimodal failure of the two components of the composite. Cleavage and separation of the relatively brittle W wires is typical of W in composites. In contrast, the veinous pattern seen on the amorphous alloy phase is consistent with the failure of monolithic BMGs under dynamic rate loading.

EXAMPLE 3

Figure 8A:
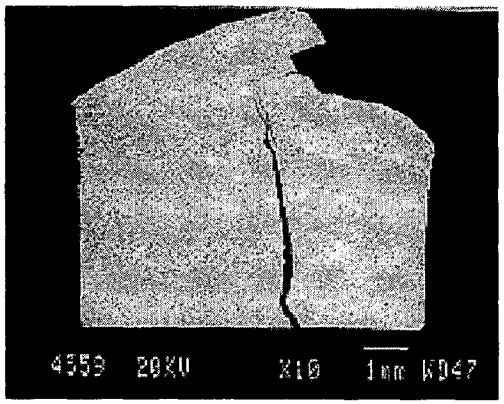
FIGS. 8*a*–8*c* are SEM images of recovered projectile residual fragment in accordance with the invention wherein: (a) illustrates a macrograph of the projectile residual, (b) illustrates a close-up view of the impact surface, and (c) illustrates a close-up view of the subsurface, respectively.
Figure 8B:
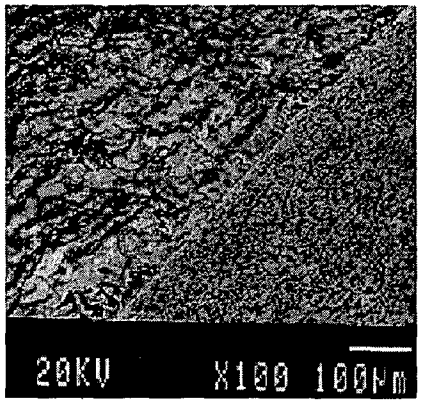
Figure 8C:
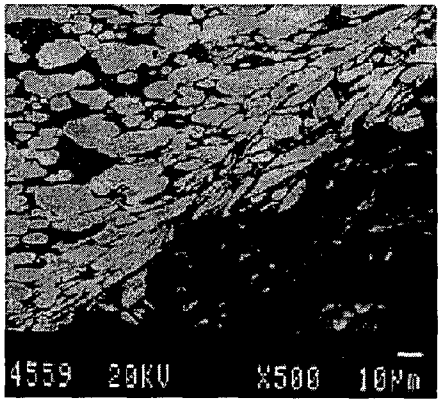

Fragments of a second, powder-reinforced W—BMG [W—$Zr_{52.5}Ti_5Ni_{14.6}Cu_{17.9}Al_{10}$ matrix] composite recovered from an inventive apparatus per Example 2 are examined using SEM. Representative micrographs are shown in FIGS. 8(*a*), 8(*b*) and 8(*c*). Unlike the W-wire reinforced projectile with highly rounded tips, the W-powder reinforced material has an angular cross section. As shown in FIG. 8(*a*), the substructure is clearly visible in the cross section of the recovered chip. The section of the composite below the surface reveals several features; the first is the W particles, the lightest shaded phase, embedded in the unchanged amorphous alloy matrix which appears as a medium gray phase as shown in FIG. 8*b*. The second feature is the presence of a few small pores which appear as a black phase as shown in FIG. 8*c*. These pores are approximately one micrometer in size and appear to be widely dispersed. These pores existed in the composite prior to the ballistic test.

The foregoing figures and descriptions thereof are provided as illustrative of a preferred embodiment of this invention and are not intended to be all inclusive. It is understood that various changes to the essential components and additions to the system and/or method may be resorted to without departing from the spirit of the invention or scope of the claims as presented.

We claim:

1. An apparatus for recovering projectile material fragments ejected by an impact, said apparatus comprising:

a projectile containment chamber having an interior volume;

a target having a front side and a back side, said target being disposed within said chamber to contact a projectile introduced into said chamber at a rate sufficient to generate said projectile material fragments;

a solvent-soluble granulated material disposed within the interior volume of said containment chamber and completely encompassing at least one side of said target to thereby capture said projectile material fragments therein;

wherein said projectile containment chamber comprises a front wall, a pair of opposed side walls, and a back wall defining said interior volume, and further including a removable lid adapted to cover an open top side of said projectile containment chamber;

wherein said solvent soluble granulated material substantially completely fills said projectile containment chamber; and wherein each of said walls has a rimmed upper edge for supporting said removable lid, and further including a gasket interposed between said rimmed upper edge and said removable lid.

2. The apparatus of claim 1 wherein the solvent soluble granulated material has a grain size comparable to a size of the smallest projectile material fragments.

3. The apparatus of claim 1 further comprising an aperture formed in a wall of said projectile containment chamber.

4. The apparatus of claim 1 wherein the projectile containment chamber is formed of greater than 0.25-inch steel.

5. The apparatus of claim 1 wherein the solvent-soluble granulated material is a salt.

6. The apparatus of claim 1 wherein the solvent-soluble granulated material is operative to capture and quench pyrophoric projectile material fragments.

7. The apparatus of claim 5 wherein the salt is non-reactive with said projectile material fragments.

8. The apparatus of claim 5 wherein the salt is sodium chloride.

9. The apparatus of claim 3 wherein the aperture is at least 25 millimeters in diameter.

10. The apparatus of claim 1 further comprising at least one backstop disposed within the containment chamber operative to prevent the target material from moving in at least one direction after being impacted by the projectile.

11. The apparatus of claim 1 wherein the solvent-soluble granulated material is a salt selected from the group comprising of an alkali or alkali earth metal salt.

12. The apparatus of claim 11 wherein said front wall includes means defining an aperture therein for passage of a projectile therethrough.

13. The apparatus of claim 12 further comprising at least one backstop disposed within said projectile containment chamber operative to prevent said target from moving in at least one direction after being impacted by the projectile.

14. The apparatus of claim 13 wherein said solvent-soluble granulated material disposed within the interior volume of said containment chamber completely encompasses the entire target to thereby capture said projectile material fragments emitted to either side of said target.

15. The apparatus of claim 1 wherein said solvent-soluble granulated material disposed within the interior volume of said containment chamber completely encompasses the entire target to thereby capture said projectile material fragments emitted to either side of said target.

* * * * *